United States Patent [19]

Hashizume

[11] 4,034,546

[45] July 12, 1977

[54] FALSE TWISTING SPINDLE OF FLUID JET DRIVING TYPE

[75] Inventor: Hiroshi Hashizume, Kyotoshi, Japan

[73] Assignee: Murata Kikai Kabushiki Kaisha, Kyotoshi, Japan

[21] Appl. No.: 656,339

[22] Filed: Feb. 9, 1976

[30] Foreign Application Priority Data

Feb. 13, 1975 Japan ..... 50-18560

[51] Int. Cl.[2] ..... D01H 1/24; D01H 7/92; D02G 1/06

[52] U.S. Cl. ..... 57/77.45; 57/101

[58] Field of Search ..... 57/77.3, 77.45, 101

[56] References Cited

U.S. PATENT DOCUMENTS

| | | | |
|---|---|---|---|
| 3,392,519 | 7/1968 | Parker | 57/77.45 |
| 3,759,025 | 9/1973 | Takai et al. | 57/77.3 |
| 3,927,517 | 12/1975 | Kimoto | 57/77.45 |
| 3,950,930 | 4/1976 | Shinds et al. | 57/77.45 |

*Primary Examiner*—Richard C. Queisser
*Assistant Examiner*—Charles Gorenstein
*Attorney, Agent, or Firm*—Whittemore, Hulbert & Belknap

[57] ABSTRACT

A false twisting spindle driven by jet fluid. The false twisting spindle comprises a housing, a rotary member including a tubular body having a twist pin and a turbine blade and a fluid bearing supporting the rotary member in the housing of the spindle. The rotary member rotates higher than 1,000,000 r.p.m.

7 Claims, 4 Drawing Figures

FALSE TWISTING SPINDLE OF FLUID JET DRIVING TYPE

BACKGROUND OF THE INVENTION:

The present invention relates to a false twisting spindle of the fluid jet driving type. More particularly, the invention provides a false twisting spindle of the fluid jet driving type in which the rotation number of the spindle is at least 10,000,000 r.p.m.

An inventor has considered that if the rotation number is decided by the balance between the driving torque and the load torque, increase of the fluid jet pressure would result in increase of the rotation number. Based on this consideration, the fluid jet pressure had been increased and it was found that a maximum rotation number is obtained when the fluid jet pressure is a certain critical value and if the fluid jet pressure is increased beyond this critical value, the rotation number is lowered conversely, and that the value of the maximum rotation number varies depending on the diameter of the turbine blade and the value of the fluid pressure providing a maximum rotation number also varies depending on the diameter of the turbine blade. Standing on these finding, the present invention has been completed.

SUMMARY OF THE INVENTION

An object of the present invention is to provide an economically advantageous false twisting spindle of the fluid jet driving type in which the rotation number of the spindle is at least 1,000,000 r.p.m. under the load.

Various experiments have been made repeatedly and a graph as shown in FIG. 2 has been obtained successfully. Empirical formula of the characteristic curve were induced from this graph. Turbine blades were designed based on these data and satisfactory results was obtained by using these turbine blades. The numerical value conditions defined by the empirical formula specify a false twisting spindle having a rotation number of at least 1,000,000 r.p.m. and a much reduced consumption of the fluid, namely an economically advantageous false twisting spindle. Indeed, it is possible to design a turbine blade capable of rotating at a roatation number of at least 1,000,000 r.p.m. even if the above numerical value conditions are not satisfied. However, in these turbine blades, economical disadvantages such as excessive consumption of the fluid are inevitably brought about.

DETAILED DESCRIPTION OF THE INVENTION

The present invention will now be described in detail by reference to the accompanying drawings.

Figure 1:
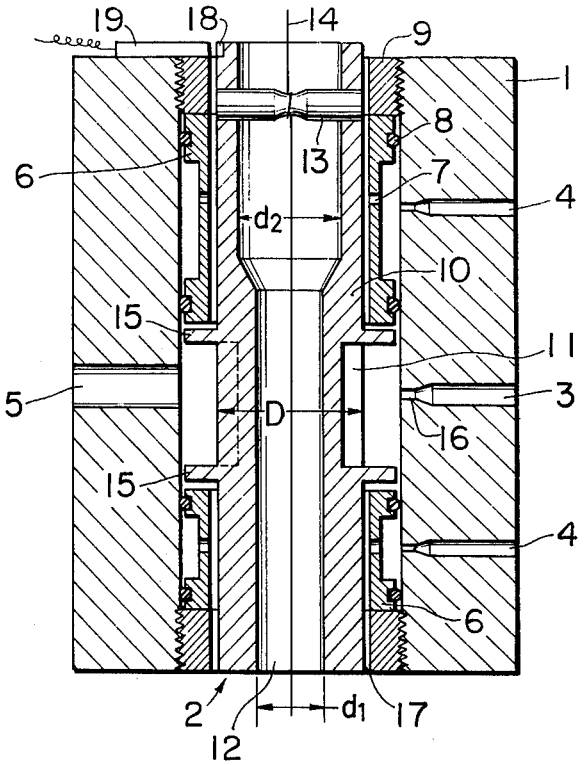
FIG. 1 is a sectional front view of the false twisting spindle of the present invention.

Referring now to FIG. 1 showing the false twisting spindle of the present invention, a rotary member 2 is disposed in a housing 1 in which compressed fluid passages 3 and 4 and a discharge passage 5 are formed. A fluid rotating the rotary member 2 is passed through the fluid passage 3 and a fluid supporting the rotary member 2 is passed through the fluid passage 4 and supplied to an air bearing 6. A fluid inlet 7 is disposed to feed the fluid to the air bearing 6. The air bearing 6 is provided with a rubber ring 8 and is set to the housing 1 by a ring 9 having a screw on the outside thereof.

The rotary member 2 has a turbine blade 11 formed on the surface of a tubular body 10 and a twist pin 13 disposed to traverse a yarn-passing hole 12 in the interior of the tubular body 10. The yarn-passing hole 12 may have an enlarged diameter *d*-2 at the attachment position of the twist pin 13 and a reduced diameter *d*-1 at the attachment position of the turbine blade 11, whereby the operation of passing yarn 14 through the yarn-passing hole 12 while being wound on the twist pin 13 can be facilitated and a sufficient thickness of the tubular body can be ensured so that when the diameter of the turbine blade is reduced and the turbine blade intrudes onto the tubular body 10, it does not reach the yarn-passing hole. This arrangement is one of the features which evable the design of the present invention to be attained in which the diameter of the turbine blade can be reduced up to 1 mm, which has been considered impossible in the art. Of course, it is possible to reduce the diameter of the turbine blade as intended in the present invention by adopting other suitable arrangement. In the embodiment shown in FIG. 1, the diameter D of the turbine blade is equal to the outer diameter of the tubular body 10 at the attachment position of the pin 13. More specifically, the outer diameter of the tubular body 10 is equal throughout its length, and only a flange 15 projects from the outer diameter of the tubular member. The weight of the rotary member 2 was adjusted within a range of from 0.1 to 0.9 g when the experiments were made. The flange 15 is disposed to receive the load of the rotary member 2 in the thrust direction, and the flange diameter is determined by the weight of the rotary member and the fluid pressure. The diameter of the discharge passage 5 is designed so that the back pressure not increased due to restriction by passage 5 when a compressed fluid jet nozzle 16 is used. A hollow hole 17 is formed in the housing 1.

In the false twisting spindle having the above structure, yarn 14 is wound on the twist pin 13 of the rotary member 2 and supported by the air bearing 6 and the rotary member 2 is rotated by the compressed fluid jet nozzle 16 to effect false twisting. A 150-denier polyester yarn was processed at a twist number of 2500 t/m by using rotary members differing in the diameter of the turbine blade, namely the rotary member having a turbine blade diameter ($\phi$) of 1 mm, 2 mm, 3 mm, 4 mm, 5 mm, etc., and data of the air consumption - applied pressure to the rotary member- and rotation number of the rotary member were collected to obtain results shown in FIG. 2. When the diameter of the turbine blade exceeds 5 mm, a rotation number higher than 1,000,000 r.p.m. cannot be obtained, and hence, it is considered that such large diameter is hardly useful for designing a super-high speed rotary member. From the graph shown in FIG. 2, it is seen that when the turbine blade having a diameter of 4 mm is used and the fluid pressure is increased, before the fluid pressure reaches the point k where the curve of the rotary member having a turbine blade diameter of 4 mm crosses the curve of the rotary member having a turbine blade diameter of 3 mm, a higher rotation number can be obtained in the former rotary member than in the latter rotary member and that if the fluid pressure exceeds the point K, a higher rotation number can be obtained in the latter rotary member when compared based on the same air consumption.

Figure 3:
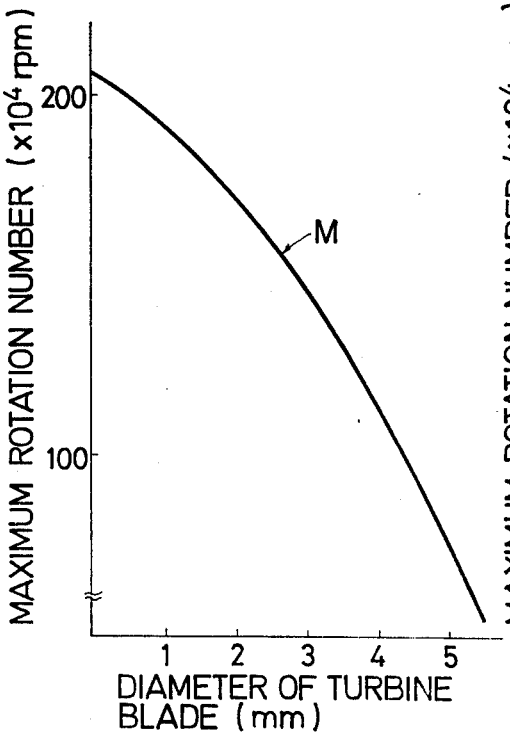
FIGS. 3 and 4 are diagrams illustrating the relation between the turbine blade diameter and the rotation number of the rotary member.
Figure 2:
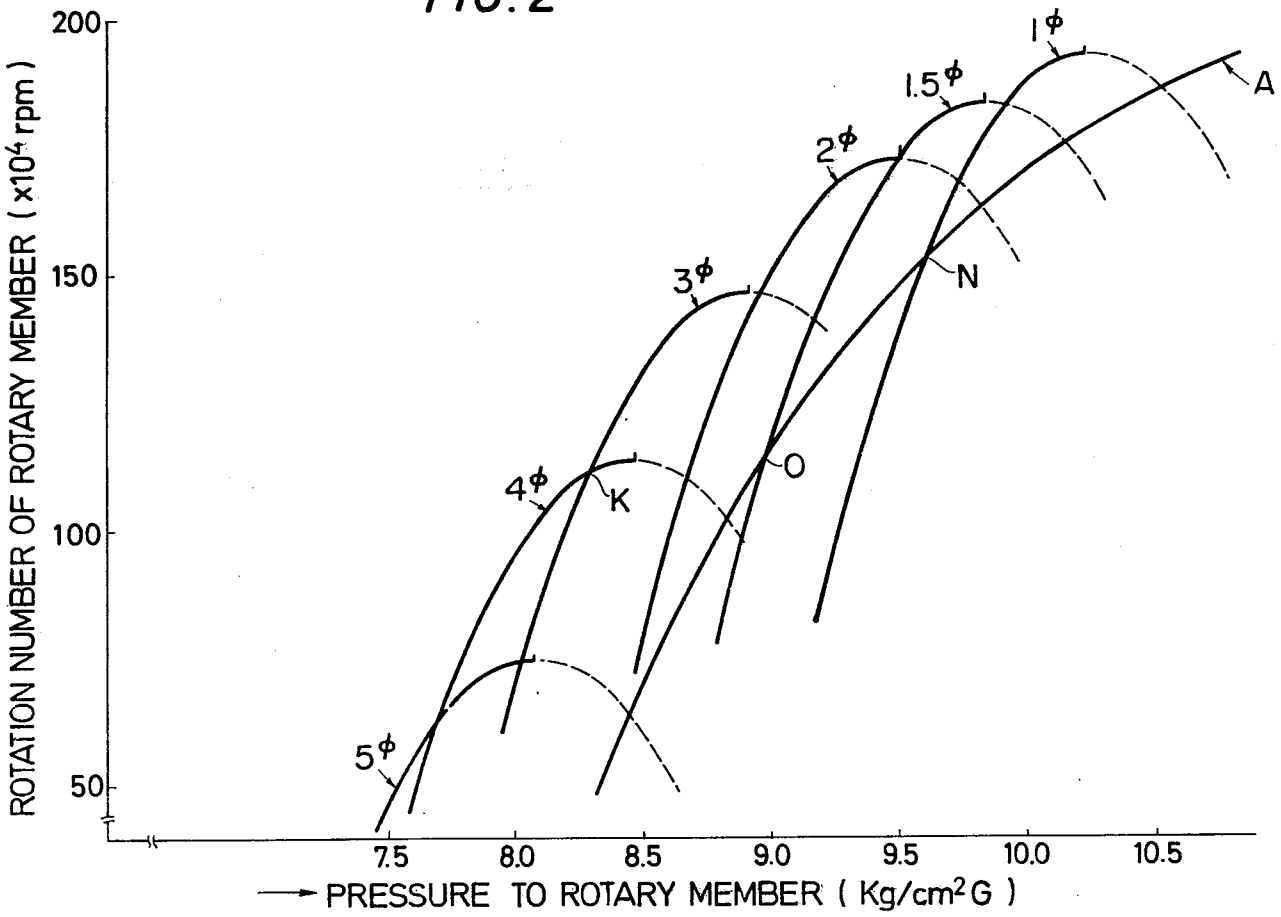
FIG. 2 is a diagram illustrating the relation between the rotation number and the fluid pressure in spindles differing in the turbine blade diameter.

Average maximum rotation numbers of respective turbine blade diameters (for example, $182.80 \times 10^4$ r.p.m. in the case of the turbine blade diameter of 1.5 mm and $113.58 \times 10^4$ r.p.m. in the case of the turbine blade diameter of 4 mm) were read from the graph of FIG. 2 and a graph shown in FIG. 3 was prepared from these values. From this graph, it was found that between the turbine blade diameter D expressed in mm and the maximum rotation number N expressed in $10^4$ r.p.m., a relation represented by the following formula is established:

$$N = 214.4 - 25/8(1.68 + D)^2 \quad (1)$$

The above value of the maximum rotation number is an average value obtained with respect to several rotary members having the same turbine blade diameter. It was experimentarily confirmed that maximum rotation numbers are distributed within the range of ± 200,000 r.p.m. from the average maximum rotation number shown in FIG. 2 depending on such factors as configuration of turbine blades, difference in injection opening forms of nozzles, clearance between a turbine blade and an inner wall of a housing, surface finish condition and moisture content of air. It means that rotation of a spindle is influenced by these factors. If the upper limit values are taken in account, when the diameter D is within a range of 1 to 5 mm, the following relation is established between N and D:

$$N = 234.4 - 25/8(1.68+D)^2 \quad (2)$$

Accordingly, it is seen that when a certain rotation number is fixed, a certain optimum turbine blade diameter providing a minimum air consumption is present. The average minimum air consumption obtained at this point is expressed as follows:

$$P = 40.26/(D + 5.843) + 4.367 \quad (3)$$

Figure 4:
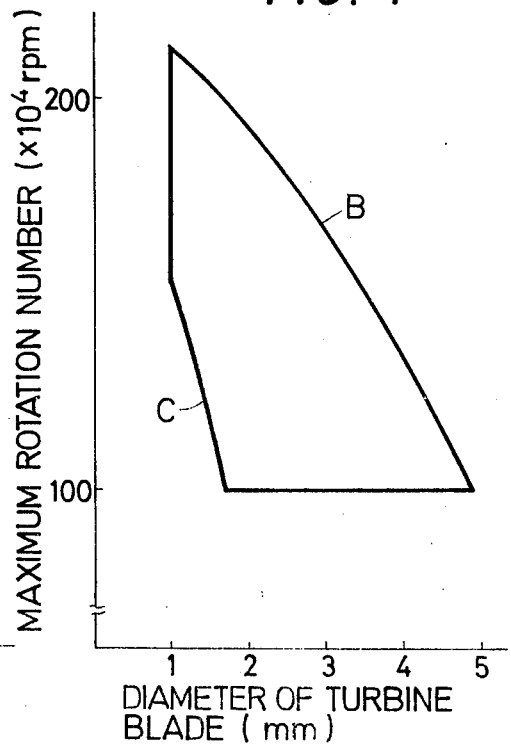

The formula (1) was plotted as curved M in FIG. 3 and the formula (2) was plotted as curved B in FIG. 4.

In practical false twisting processing, however, the rotation conditions are often changed depending on the yarn denier and required cripm characteristic. It is inconvenient to exchange the spindle of the turbine blade so as to obtain a minimum air consumption every time the rotation conditions are slightly changed according to the above factors, if the expenses for the exchange operation, the time loss for the exchange operation and the necessity of preparation of a variety of spindles are taken in account. Therefore, based on experimental data, investigations were made to determine an allowable range of the rotation number for a fixed turbine blade diameter within which the twisting processing operation can be performed economically advantageously in view of the air consumption and the economy-influencing factors as mentioned above even if the air consumption is not an optimum minimum value. As a result, it was found that if the actual air consumption is larger by up to 6% than the air consumption at the maximum rotation number expressed by the formula (1), the operation can be performed economically advantageously with respect to all of the foregoing economy-influencing factors. More specifically, when the turbine blade diameter is 2 mm, the maximum rotation number is $172.08 \times 10^4$ r.p.m. A minimum air consumption at this point is 9.5 kg/cm$^2$ as expressed as the fluid pressure, and within a range on the left side of the line A in FIG. 2, which indicates the air consumption larger by 6% than the minimum air consumption (namely, the air pressure of 10.07 kg/cm$^2$), a turbine blade having a diameter smaller than 2 mm, for example, a turbine blade having a diameter of 1.5 mm, can be used without inviting particular economical disadvantages. This allowable range was plotted as curve C in FIG. 4. More specifically, the curve C in FIG. 4 was obtained from the curve A in FIG. 2 which indicates maximum rotation numbers as a characteristic curve of 6%-increased air consumptions at respective diameters, by plotting, for example, the rotation number at the point N where the characteristic curve of the 1 mm-diameter turbine blade crosses the curve A, the rotation number at the point 0 where the characteristic curve of the 1.5 mm-diameter turbine blade crosses the curve A, the rotation number at the point where the 2 mm-diameter turbine blade crosses the curve A and rotation numbers at similar crossing points. This curve C is expressed by the following formula:

$$N = 170.81 - 44(D - 4/11)^2 \quad (4)$$

Thus, when the rotation number is higher than 1,000,000 r.p.m., the false twisting spindle being excellent in the operation capacities and being comprehensively advantageous from the economical viewpoint can be obtained by electing the rotation number and the diameter of the rotary member optionally from which are in the range surrounded by the curves B and C and defined the diameter of the turbine blade to be larger than 1 mm as shown in FIG. 4.

In other words, such desirable false twist spindles can be obtained when the following conditions are satisfied:

$$1 \leqq D < 5,$$

and $$170.81 - 44(D - 4/11)^2 \leqq N \leqq 234.4 - 25/8(1.68 + D)^2$$

wherein N is the rotation number of the rotary number expressed in $10^4$ r.p.m. and D is the diameter of the turbine blade expressed in mm.

In case a spindle having a turbine blade diameter of 1.5 mm is used instead of the above-mentioned spindle having a turbine blade diameter of 2 mm or in case a variation is caused in the fluid used as a driving source, the operation cannot be performed unless suitable control means are disposed. As such control means, there can be used any of known mechanisms. For example, a magnet 18 is mounted on the rotary member 2 so that the rotation number is detected by a sensor 19, and signals of the sensor 19 are put in a comparator connected to a prescriber. When a deviation is caused, control signals are emitted through a controller to a servo metor controlling a servo valve formed on a fluid supply conduit. By adopting such control mechanism, good results are obtained if the desired fluid consumption is put in the prescriber.

One embodiment of the false twisting spindle of the present invention will now be described.

When the twisting operation was conducted under a fluid pressure of 9.194 kg/cm² by using a spindle of the present invention having a turbine blade diameter of 2.5 mm, although it was impossible to obtain a prescribed rotation number of 1,620,000 r.p.m., a rotation number of 1,600,000 r.p.m. was obtained.

When the turbine blade diameter is 4 mm, a minimum air consumption is 8.457 kg/cm² at a rotation number of 1,135,800 r.p.m. When a spindle of the present invention including a turbine blade having a diameter of 2 mm was employed, the air consumption was larger by only 5 % than the air consumption when the turbine blade having a diameter of 4 mm was used. Thus, it was confirmed that the twisting operation can be performed economically advantageously by using the false twisting spindle of the present invention without provision of a variety of turbine blades.

What is claimed is:

1. A false twisting spindle of the fluid jet driving type having a rotation number more than 1,000,000 r.p.m. comprising a housing, a rotary member including a tubular body having a twist pin in a yarn-passing hole perforated therein and a turbine blade for receiving a rotation inducing fluid and a fluid bearing supporting the rotary member, said rotary member and said fluid bearing being disposed in a hollow hole of the housing, wherein a diameter of said turbine blade D and a rotation number N of said rotary member have the following relation:

$$1 \leqq D < 5,$$

and $$170.81 - 44(D - 4/11)2 \leqq N \leqq 234.4 - 25/8(1.68 + D)^2$$

in which N is expressed in $10^4$ r.p.m. and D is expressed in mm, and wherein the diameter of the turbine blade is the same as the outside diameter of the tubular body of the rotary member.

2. Structure as set forth in claim 1, and further including a radially extending annular flange on the rotary member tubular body at each end of the turbine blade.

3. A false twisting spindle comprising a body member having an opening therethrough, a rotatable hollow tubular member within the opening in the body member and yarn twisting means in the tubular member, and turbine blades positioned on the tubular member having an outside diameter not greater than the outside diameter of the tubular member.

4. Structure as set forth in claim 3 wherein the outside diameter of the turbine blades is equal to the outside diameter of the tubular member.

5. Structure as set forth in claim 3, wherein the tubular member has larger and smaller inner diameter ends, a twist pin is positioned transversely of the larger diameter end and the turbine blades are positioned on the smaller diameter end of the tubular member.

6. Structure as set forth in claim 5, and further including annular radially extending flanges on the tubular member at each end of the turbine blades.

7. Structure as set forth in claim 3, and further including annular radially extending flanges on the tubular member at each end of the turbine blades.

* * * * *